US007012208B2

(12) United States Patent
Wang

(10) Patent No.: US 7,012,208 B2
(45) Date of Patent: Mar. 14, 2006

(54) THIN SWITCH

(75) Inventor: Yung-Hui Wang, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 97 days.

(21) Appl. No.: 10/731,129

(22) Filed: Dec. 10, 2003

(65) Prior Publication Data

US 2005/0126900 A1 Jun. 16, 2005

(51) Int. Cl.
*H01H 13/14* (2006.01)
*H01H 3/12* (2006.01)

(52) U.S. Cl. ..... 200/341; 200/406; 200/516; 200/517

(58) Field of Classification Search ..... 200/406, 200/512, 513, 517, 516, 341
See application file for complete search history.

(56) References Cited

U.S. PATENT DOCUMENTS 5,172,114 A * 12/1992 Bedoya et al. ..... 341/27
5,199,557 A * 4/1993 Brandt et al. ..... 200/406
5,772,010 A * 6/1998 Watanabe et al. ..... 200/406
6,140,596 A * 10/2000 Tsay ..... 200/406
6,271,487 B1 * 8/2001 Domzalski et al. ..... 200/1 B
6,664,491 B1 * 12/2003 Yanai et al. ..... 200/516
6,670,566 B1 * 12/2003 Wang ..... 200/406

FOREIGN PATENT DOCUMENTS

TW 367086 8/1999
TW 378332 1/2000

* cited by examiner

*Primary Examiner*—Michael A. Friedhofer
(74) *Attorney, Agent, or Firm*—Birch,Stewart, Kolasch & Birch, LLP

(57) ABSTRACT

An improved thin switch aims at reducing overall height of switches without shortening existing compression displacement. It has a trigger assembly which includes an upper button with a bracing section housed in a compartment, a coupling trough, and a lower button with compression section held in the coupling trough without exceeding the anchor portion of the coupling trough. The lower button further has a ram section located between the compression section and the elastic element. The upper button and lower buttons may be deformed as desired to reduce the overall height of the thin switch without affecting existing compression displacement.

6 Claims, 9 Drawing Sheets

THIN SWITCH

FIELD OF THE INVENTION

The present invention relates to an improved thin switch and particularly to a thin switch for reducing the overall height without shortening the compression displacement.

BACKGROUND OF THE INVENTION

Thin and lightweight is a prevailing design trend for electronic products these days. Likewise, there is no point to have small components housed in a bulky product. Therefore all aspects of an electronic product should focus these design issues. Mating switch design is no exception. A slimmer design needs to maintain existing compression displacement so as not to affect the feeling of depressing a button. Refer to FIG. 1 for a patent granted to Applicant in ROC patent No. 367086, entitled "Improved touch switch". It comprises a seat made from an insulating material. The seat has a hollow housing with an opening on the upper side. There is a first conductive electrode located in the center of the housing. There are two second conductive electrodes located on two sides of the housing. A fastening section is located on the outer side of the seat. There is an elastic dome reed made of a conductive thin metal sheet. The elastic dome reed has a peripheral section and a protrusive section which gradually extends upwards from the peripheral section to the center. The peripheral section is in contact with the second conductive electrodes of the seat. The protrusive section is spaced from the first conductive electrode over a selected distance. When the elastic dome reed is subject to a downward force as the button is pressed, it touches the first conductive electrode. When the pressure is released, the elasticity restores. A trigger member is located above the elastic dome reed that includes an upper button made from plastic with a recess on the bottom, and a lower button made from rubber. The lower button has a jutting section on the top corresponding to and coupling tightly with the recess of the upper button. The lower button is in contact with the center area of the elastic dome reed. A cap which has an opening on the upper side and two anchor sections on two sides is provided to couple with the seat from the outer side. The anchor sections are latched on a fastening section of the seat to confine the elastic dome reed and the trigger member in the seat. The upper button of the trigger member is extended outside the opening of the cap. The aforesaid reference provides a lasting smooth surface for the upper button, and the rubber lower button is pliable and in contact with the elastic dome reed to enable the touch switch to function as desired. FIG. 2 illustrates another ROC patent No. 378332, entitled "Pushbutton switch". It differs from the previous reference by having a lower jutting section extended from an elastic driving member (lower button) to increase the displacement.

The two aforesaid references have a flat section and a lower jutting section on the lower button. Such designs are unnecessary for this type of switch, and do not really contribute to the compression displacement. As a result, they are restricted to a certain height and cannot be made thinner. Their applicability to present electronic products is limited.

SUMMARY OF THE INVENTION

Therefore the primary object of the invention is to resolve the aforesaid disadvantages. The invention provides a thin switch that reduces the overall height of the switch without shortening compression displacement. The thin switch has a trigger assembly which includes an upper button with a bracing section housed in a compartment. The upper button has a coupling trough. A lower button is provided and has a compression section housed in the coupling trough without exceeding the anchor zone of the coupling trough. The lower button further has a ram section located between the compression section and an elastic element. The upper button and the lower button thus formed generates the desired deformation to reduce the overall height of the thin switch without affecting the existing compression displacement.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
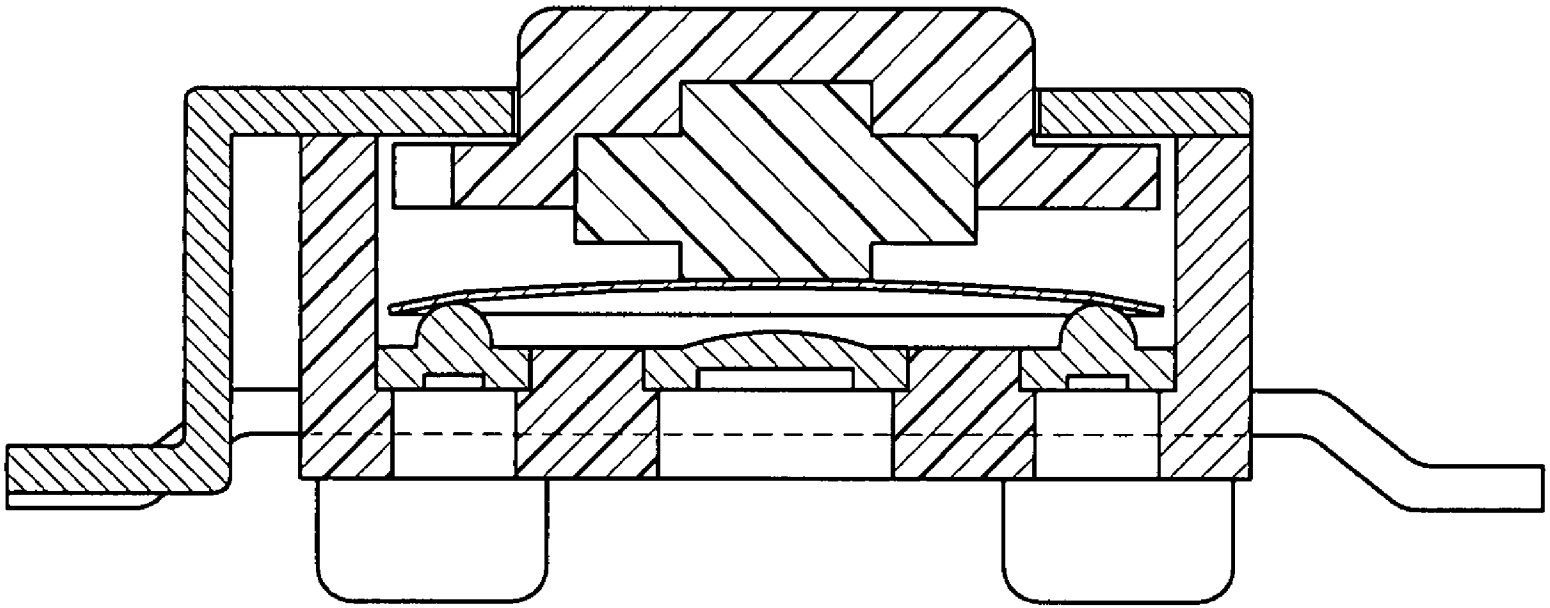
Fig. 1 PRIOR ART
FIG. 1 is a sectional view of a conventional touch switch.
Figure 2:
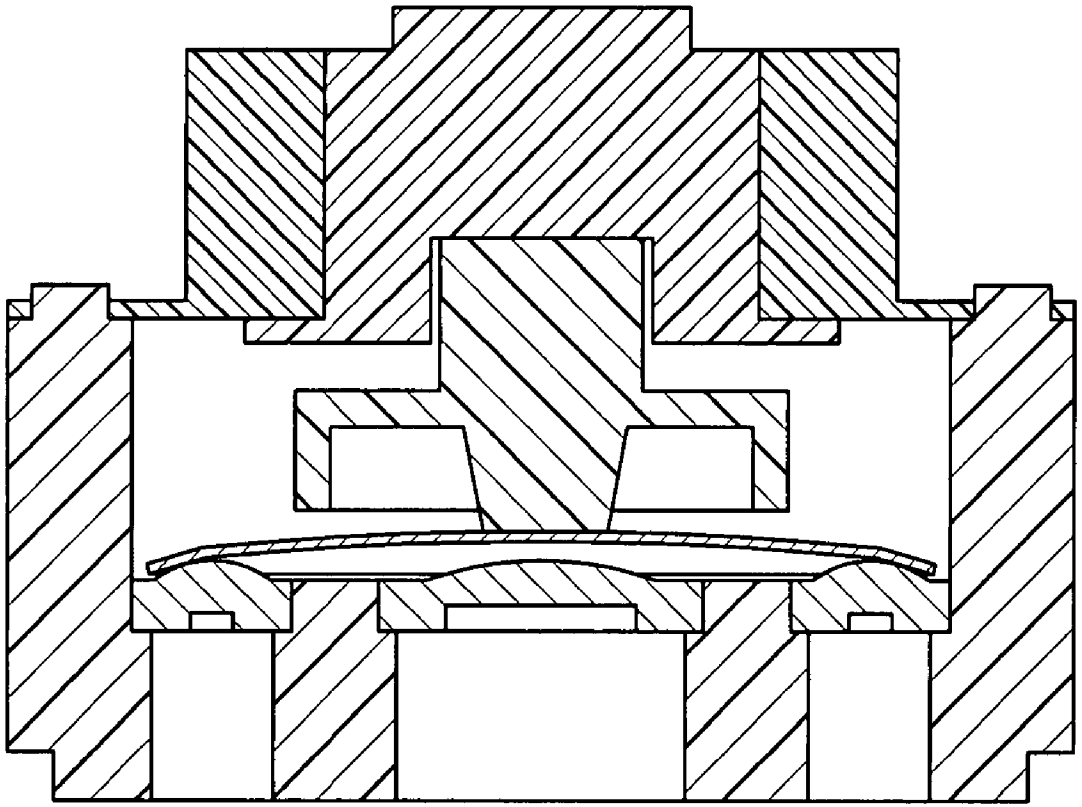
Fig. 2 PRIOR ART
FIG. 2 is a sectional view of a conventional pushbutton switch.
Figure 3:
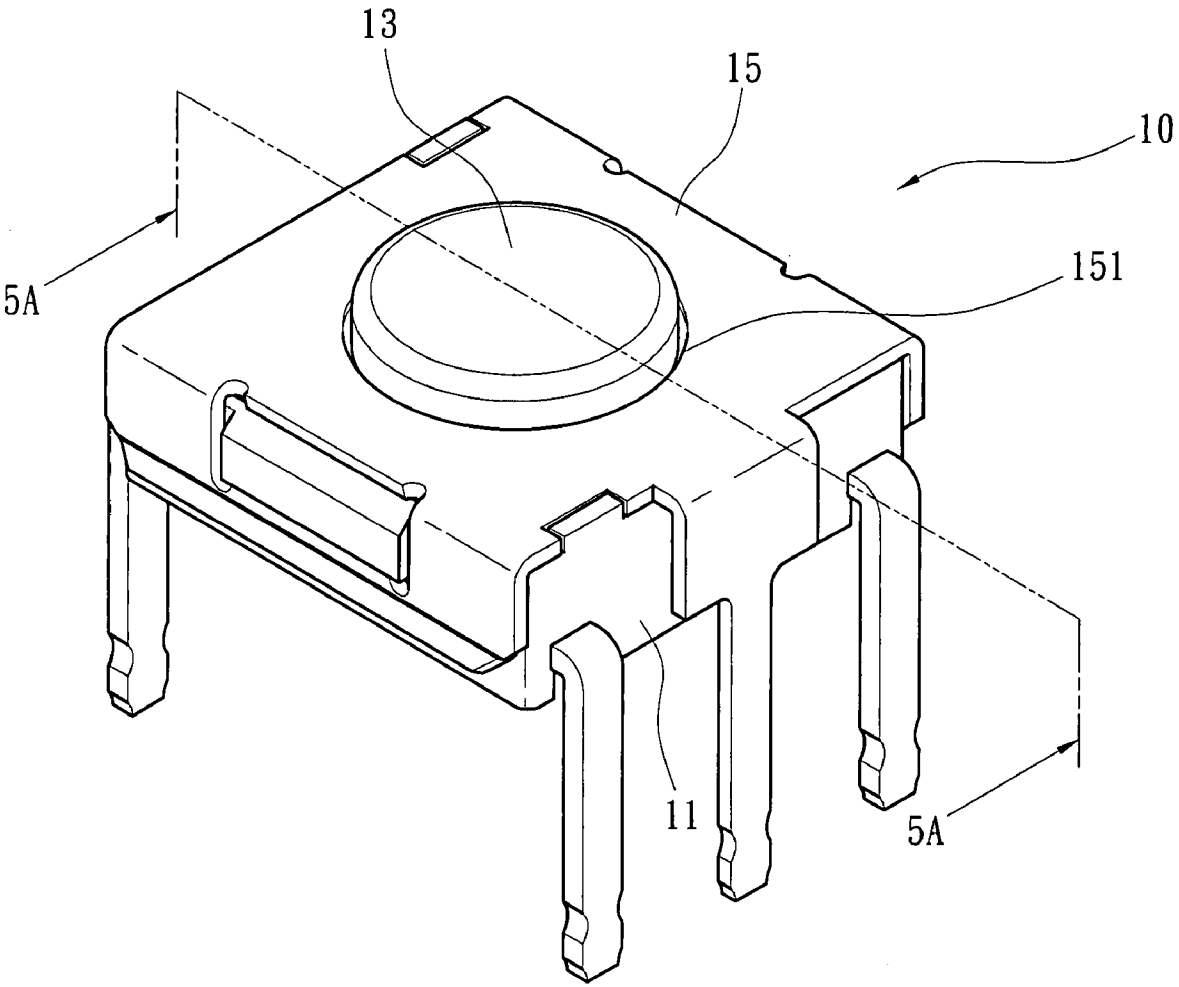
FIG. 3 is a perspective view of the present invention.
Figure 4:
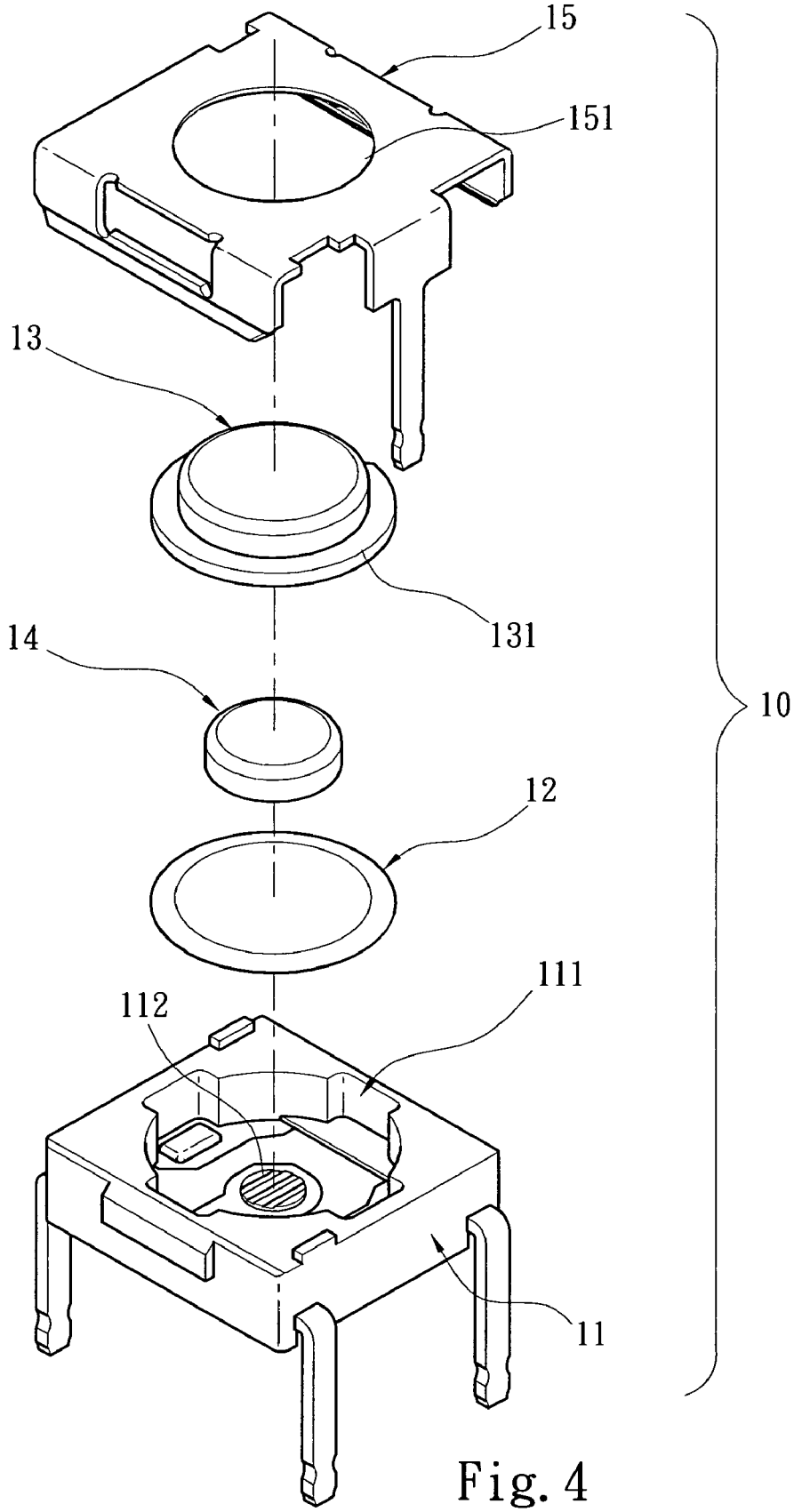
FIG. 4 is an exploded view of the invention.
Figure 5A:
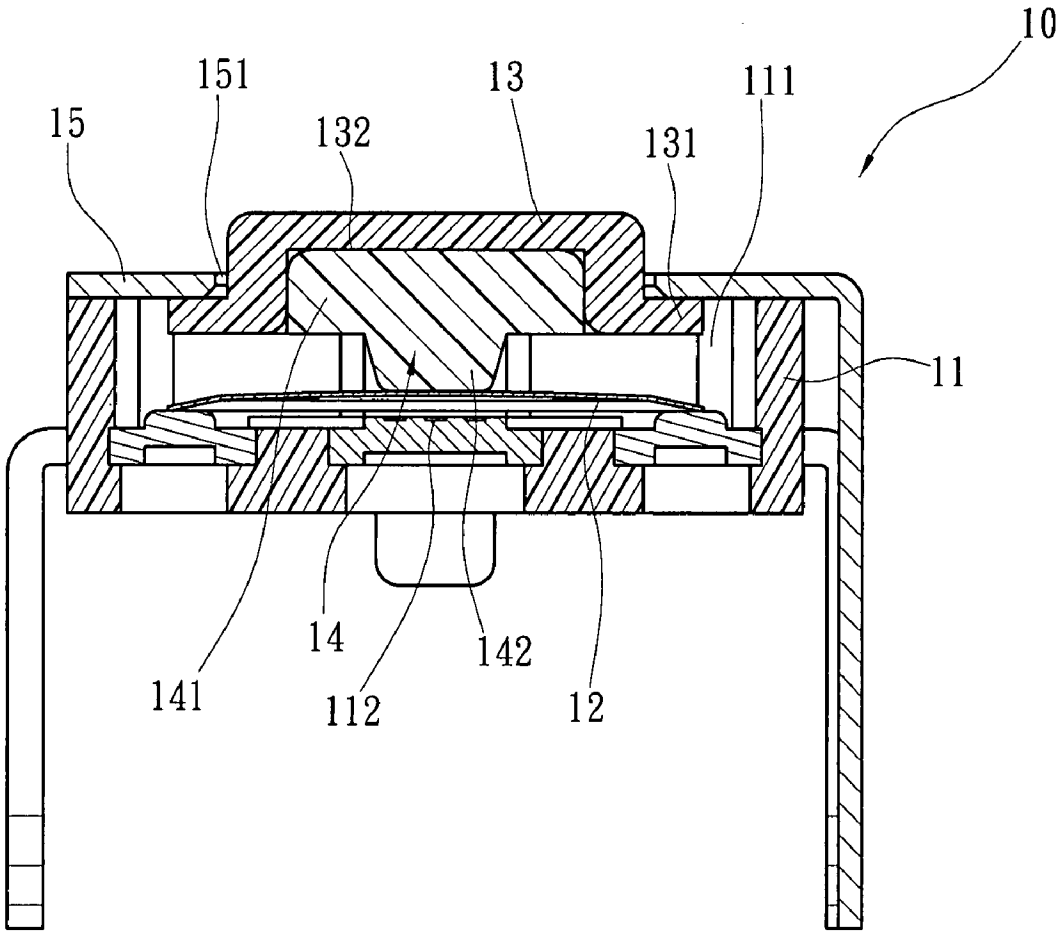
FIGS. 5A and 5B are cross sections taken on line 5A—5A in FIG. 3 showing operating conditions.

Please referring to FIGS. 4 and 5A, the switch 10 according to the invention includes a seat 11 which has a hollow compartment 111 with an opening on the upper side. The compartment 111 has an electrode section 112. There is an elastic element 12 above the electrode section 112. Above the elastic element 12 is a trigger assembly which includes an upper button 13 and a lower button 14. The seat 11 is covered by a cap 15 from to seal the compartment 111. The cap 15 has an opening 151 to enable the upper button 13 to extend outwards. The upper button 13 further has a bracing section 131 trapped in the compartment 111 and a coupling trough 132 to hold the compression section 141 of the lower button 14 without exceeding an anchor area of the coupling trough 132. The lower button 14 further has a ram section 142 located between the compression section 141 and the elastic element 12.

Figure 5B:
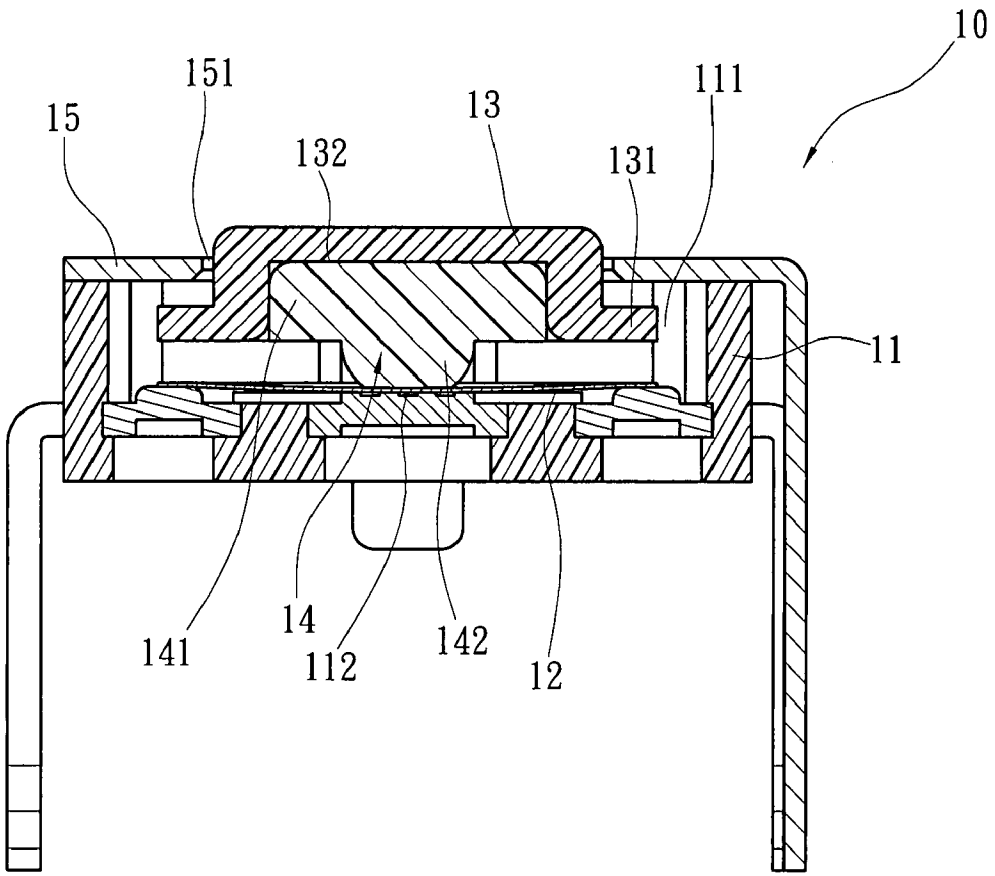
Figure 6:
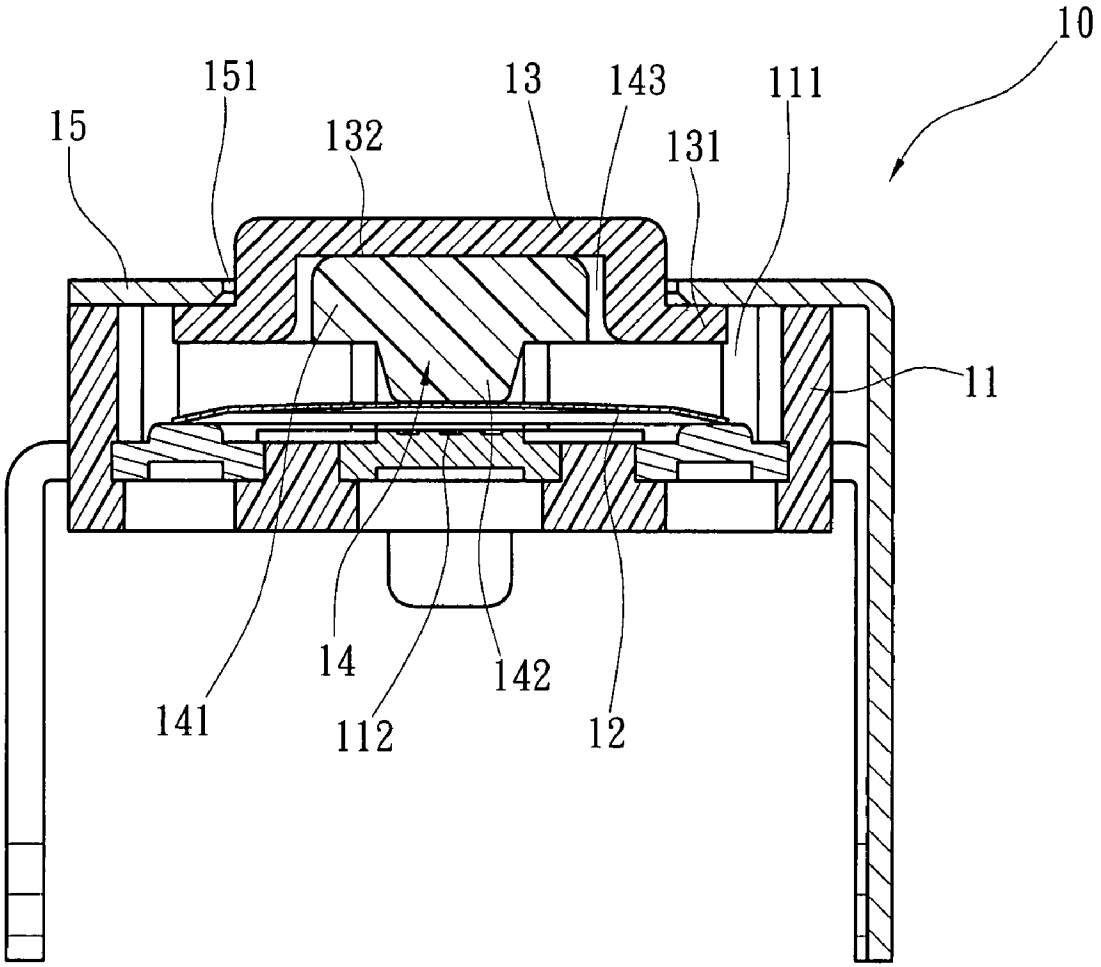
FIG. 6 is a schematic view of a second embodiment of the invention.
Figure 7:
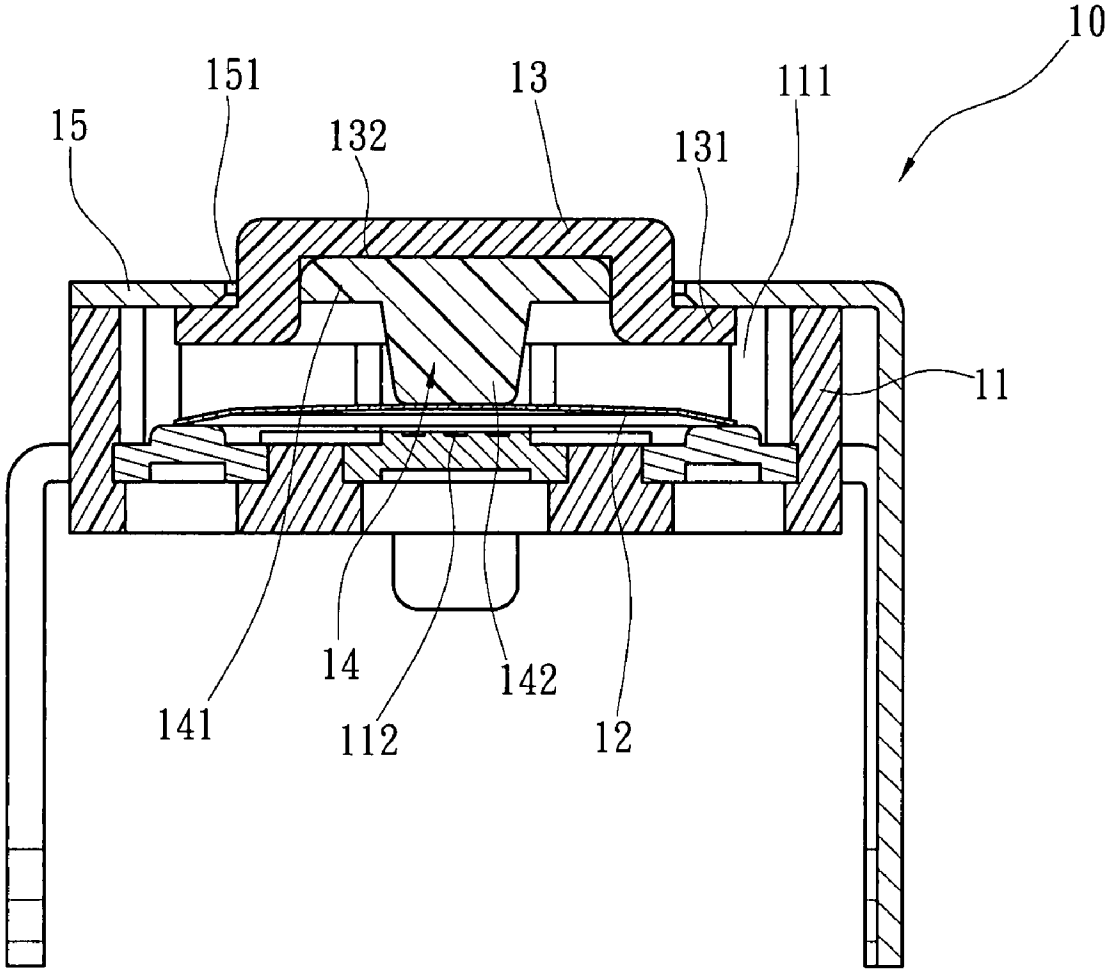
FIG. 7 is a schematic view of a third embodiment of the invention.

Referring to FIGS. 5A and 5B, when in use, the compression displacement of the trigger assembly depends on the deformation of the compression section 141 and the ram section 142. In the event that the compression 141 is tightly coupled in the coupling trough 132, the compressing deformation depends on the deformation of the ram section 142. As shown in FIG. 5A, only the compression section 142 of the lower button 14 is exposed outside the upper button 13, hence the overall height decreases. To form a control portion, it may be accomplished according to user's requirements as shown in FIG. 6. There is a gap 143 between the compression section 141 and the coupling trough 132. The displacement of the thin switch 10 may increase by including the deformation of the compression section 141 and the ram section 142. Or as shown in FIG. 7, the compression section 141 is tightly coupled with an upper portion of the coupling trough 132 to increase the extended displacement of the ram section 142. Namely when the upper button 13 is depressed, the ram section 142 fully deforms before touching the elastic element 12 and the electrode section 112 to close the circuit.

Figure 8:
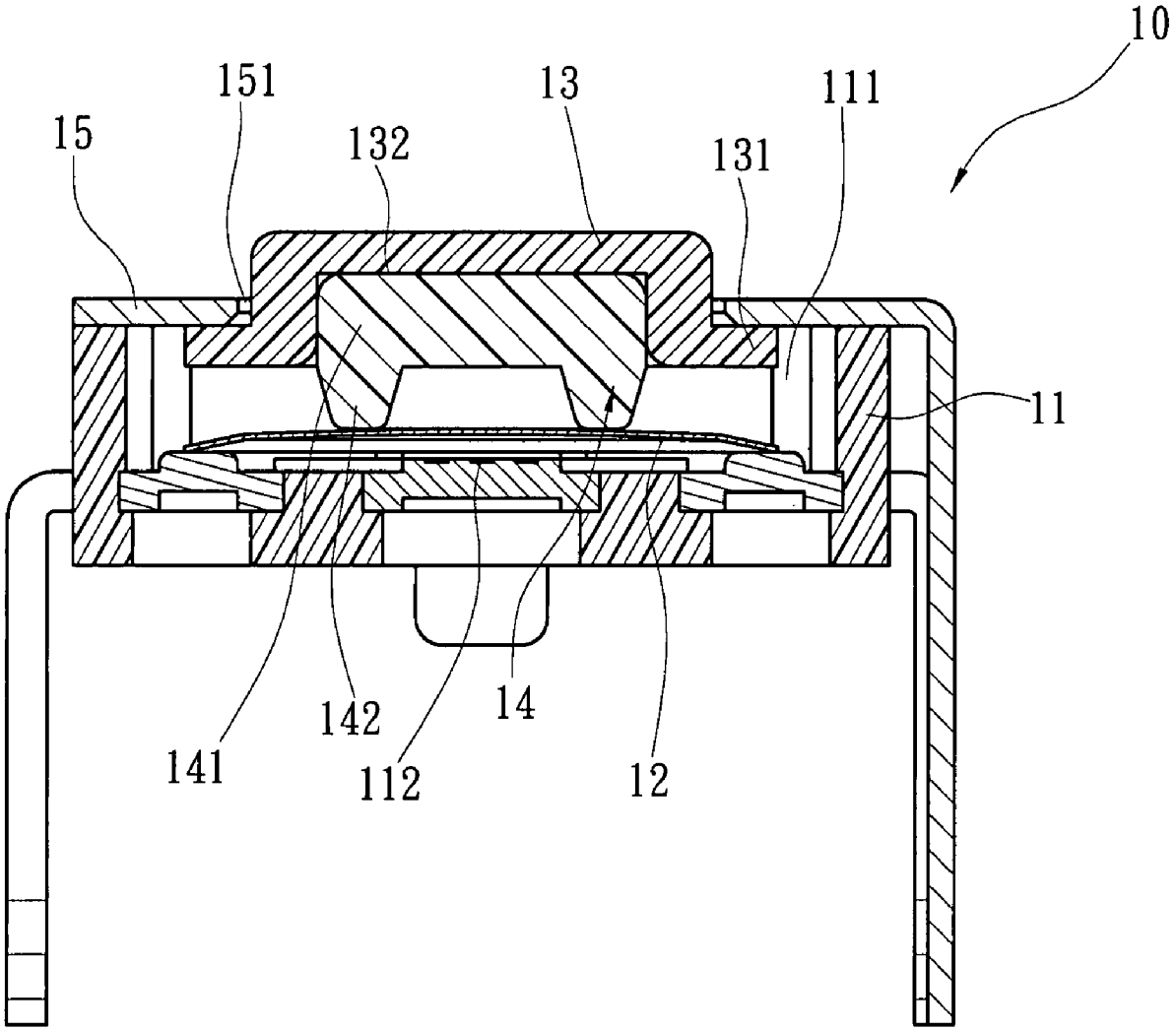
FIG. 8 is a schematic view of a fourth embodiment of the invention.

Refer to FIG. 8 for another embodiment of the invention. The ram section 142 is located on the underside of the compression section 141 rather than the center as with previous embodiments. The exposed portion can also deform without using a jutting section. Such a design produces a thinner switch 10.

What is claimed is:

1. A thin switch, comprising:

a seat having a housing compartment which has an opening on an upper side and an electrode section;

an elastic element located above the electrode section;

a trigger assembly located above the elastic element including upper and lower buttons; and a cap covering the seat having an opening to allow the upper button to extend outwards;

wherein the upper button has a bracing section housed in the compartment and a coupling trough for holding a compression section of the lower button, the compression section being completely contained in said holding trough, the lower button having a ram section, having a smaller surface area than said compression section, located between the compression section and the elastic element.

2. The thin switch of claim 1, wherein the trigger assembly has a compression displacement which is determined by deformation of the compression section and the ram section when subjected to a force.

3. The thin switch of claim 1, wherein the compression section is tightly coupled in the coupling trough.

4. The thin switch of claim 1, wherein the compression section and the coupling trough form a gap.

5. The thin switch of claim 1, wherein the ram section is located in the center of the compression section.

6. The thin switch of claim 1, wherein the ram section is located below the compression section.

* * * * *